United States Patent [19]

Dissmeyer et al.

[11] 3,983,785

[45] Oct. 5, 1976

[54] MISSILE LAUNCHER ARMING DEVICE

[75] Inventors: Dean Edwin Dissmeyer, Claremont; Frederick Ralph Sewell, San Gabriel, both of Calif.

[73] Assignee: General Dynamics Corporation, Pomona, Calif.

[22] Filed: June 17, 1974

[21] Appl. No.: 479,912

[52] U.S. Cl. ..... 89/1.812; 89/1.806; 89/1.819

[51] Int. Cl.[2] ..... F41F 3/04; F41F 3/06

[58] Field of Search ..... 89/1.5 D, 1.806, 1.807, 89/1.812, 1.819

[56] References Cited

UNITED STATES PATENTS

| | | | |
|---|---|---|---|
| 3,040,629 | 6/1962 | Duncan et al. | 89/1.806 |
| 3,166,980 | 1/1965 | Harris et al. | 89/1.812 |
| 3,166,981 | 1/1965 | Harris et al. | 89/1.806 |
| 3,742,813 | 7/1973 | Kowgelbeck | 89/1.812 |
| 3,842,711 | 10/1974 | Bodinaux | 89/1.814 |

*Primary Examiner*—Verlin R. Pendegrass
*Assistant Examiner*—S. A. Cangialosi
*Attorney, Agent, or Firm*—Henry M. Bissell; Edward B. Johnson

[57] ABSTRACT

A mechanism mounted on a missile launch rail which may be actuated to perform the functions of engaging electrical circuit firing contacts for the missile, rotating a rocket motor arming arm, and unlocking the forward motion missile restraints. Particular structure including a bi-directional linear actuator drive mechanism is provided to perform these functions. In addition, the structure incorporates the capabilities of restraining the rocket motor against full thrust in the event of an inadvertent firing and of restoring the rocket motor to safe condition if a launch is aborted.

14 Claims, 11 Drawing Figures

MISSILE LAUNCHER ARMING DEVICE

The invention herein described was made in the course of or under a contract, or sub-contract thereunder, with the Department of the Navy.

BACKGROUND OF THE INVENTION

1. Field of the Invention

This invention relates to missile launching systems and, more particularly, to such systems providing positive control of the missile until the intended launch is completed.

2. Description of the Prior Art

The task of launching missiles is fraught with hazards and problems. In essence, a launching involves the control of a partially exposed explosion. Control must be effected until the rocket propulsion motor attains a state where a successful flight is assured. Desirably, such control of the missile should also be able to deal with the problems of restraining the missile in the event of inadvertent firing and restoration of the motor to the "safe" condition ("resafing") if an initiated launch is to be aborted. Various mechanisms are known in the prior art for performing certain of the functions relating to launching of missiles. For example, U.S. Pat. No. 3,742,813 of Kongelbeck describes a mechanism which performs the function of arming a missile, releasing forward motion missile restraints and connecting electrical circuit contacts with buttons on the missle. U.S. Pat. No. 3,166,981 of Harris et al describes a mechanism for restraining a missile on launch until sufficient thrust is developed to sustain flight. Other patents of interest in connection with the functions relating to the arming and launching of missiles are U.S. Pat. Nos. 2,422,660 of Elder et al., 3,040,629 of Duncan et al., 3,049,976 of Hereth et al., 3,072,018 of Wilson, and 3,166,980 of Harris et al.

None of the known prior art presents the capability of performing all of the functions which are desired with respect to the launching of rocket propelled missiles. Moreover, the mechanisms employed in prior structural arrangements are relatively cumbersome and do not always perform their intended function in a preferred manner.

Accordingly, it is general object of the present invention to provide an improved device for effectively arming and firing missles utilizing rocket motors for propulsion.

It is a further object of the present invention to provide a missile rocket arming and firing device having the capability of performing the desired functions involved in missile launching in an improved and efficient manner.

It is a more specific object of the present invention to provide a missile launching device providing effective operation with increased safety.

SUMMARY OF THE INVENTION

In brief, arrangements in accordance with the present invention comprise a mechanism which is mounted on a launcher frame for supporting, arming and controlling an associated rocket. Rockets of the type to be used in conjunction with embodiments of the present invention particularly include a pair of protruding support brackets or shoes for engaging corresponding guide rails of the arming device. Adjacent the forward shoe are a pair of spaced electrical contacts connected to the internal ignition circuitry of the rocket and a rotatable arming lever coupled to control a switch which is also connected as part of the internal ignition circuitry. In use, the mechanism of the invention is operative to perform three functions: engagement of the electrical circuit firing contacts, rotation of the rocket motor arming lever, and release of the forward motion missile restraints. The mechanism comprises a bi-directional linear-motion driven shuttle which traverses the back of the launch rail. Pins on the shuttle engage slots in pivoted launcher-mounted electrical contact arms which, during shuttle traversal, cause engagement of the contact arms with the ignition circuit contacts on the missile. Movement of the shuttle also unlocks two laterally disposed, rotatably mounted, missile shoe forward movement restraints. A shear pin element in the mechanism allows final restraint release upon attainment of the desired rocket motor thrust. A missile arming member is pivotably mounted on the shuttle so as to engage the arming lever of the missile. Thus, movement of the shuttle causes cammed rotation of the arming lever. Pivotable movement of the arming member prior to missile launch is prevented by a latch element associated with the arming device. Missile restraint release causes the latch element to rotate, thus permitting the arming member to be retracted by a spring bias element so as to clear the aft missile guide shoe. The mechanism as thus described allows the missile to be armed, the restraints prepared for launch and the rocket motor firing circuit to be closed by a single movement of the shuttle. If the launch is aborted, the rocket motor can be "resafed" by reversing the traversal of the shuttle member. The missile can be restrained against full thrust by this mechanism in the event of an inadvertent firing.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 10:
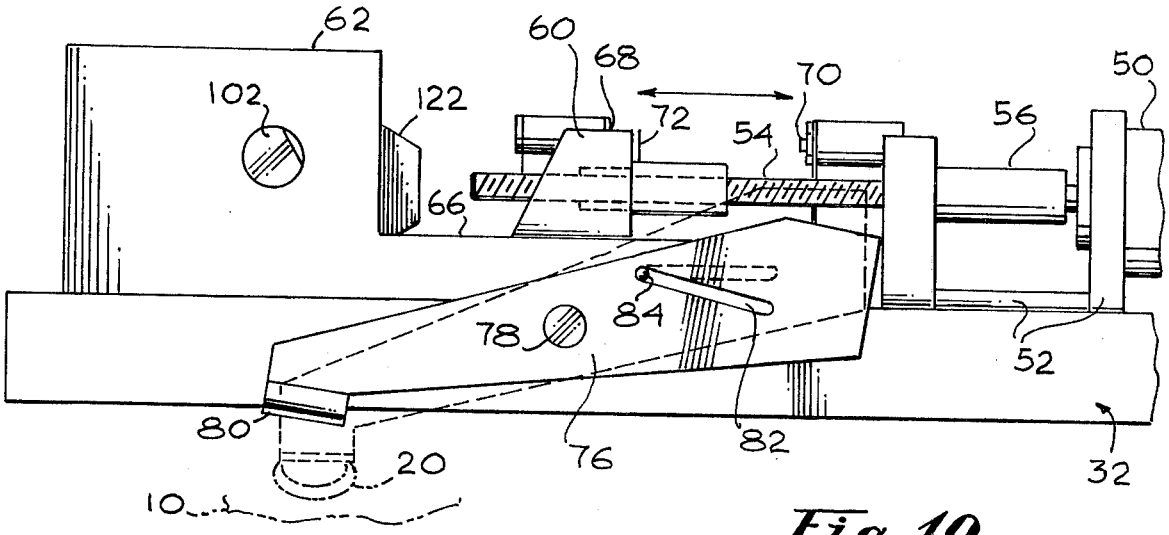
FIG. 10 is a partial side elevational view in schematic form showing the operation of the mechanism of FIG. 3.
Figure 4:
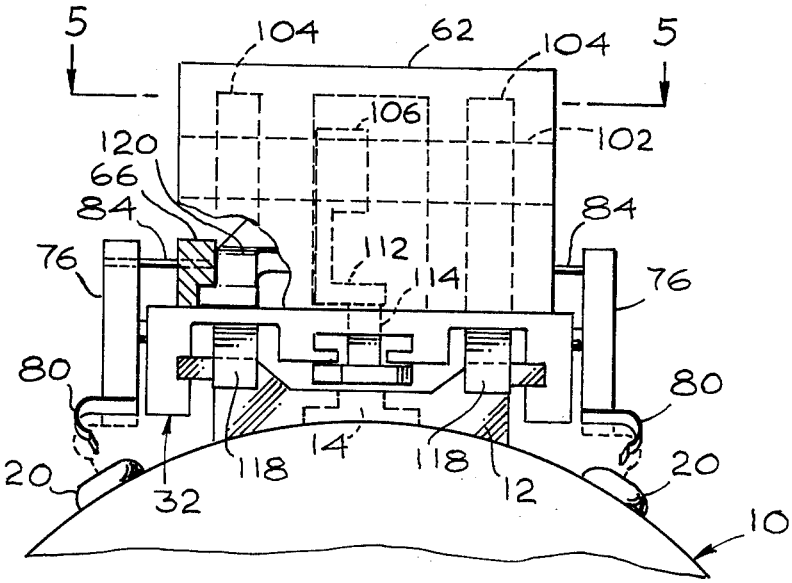
FIG. 4 is an end view, partially broken away, of the mechanism of FIG. 3, viewed from the left-hand end.
Figure 1:
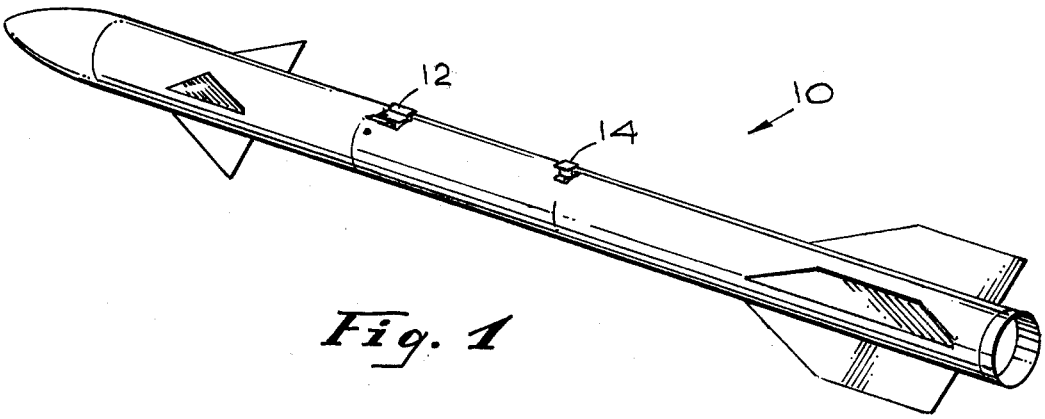
FIG. 1 is a perspective view of a missile as operated in conjunction with embodiments of the present invention.
Figures 2, 3, 3A:
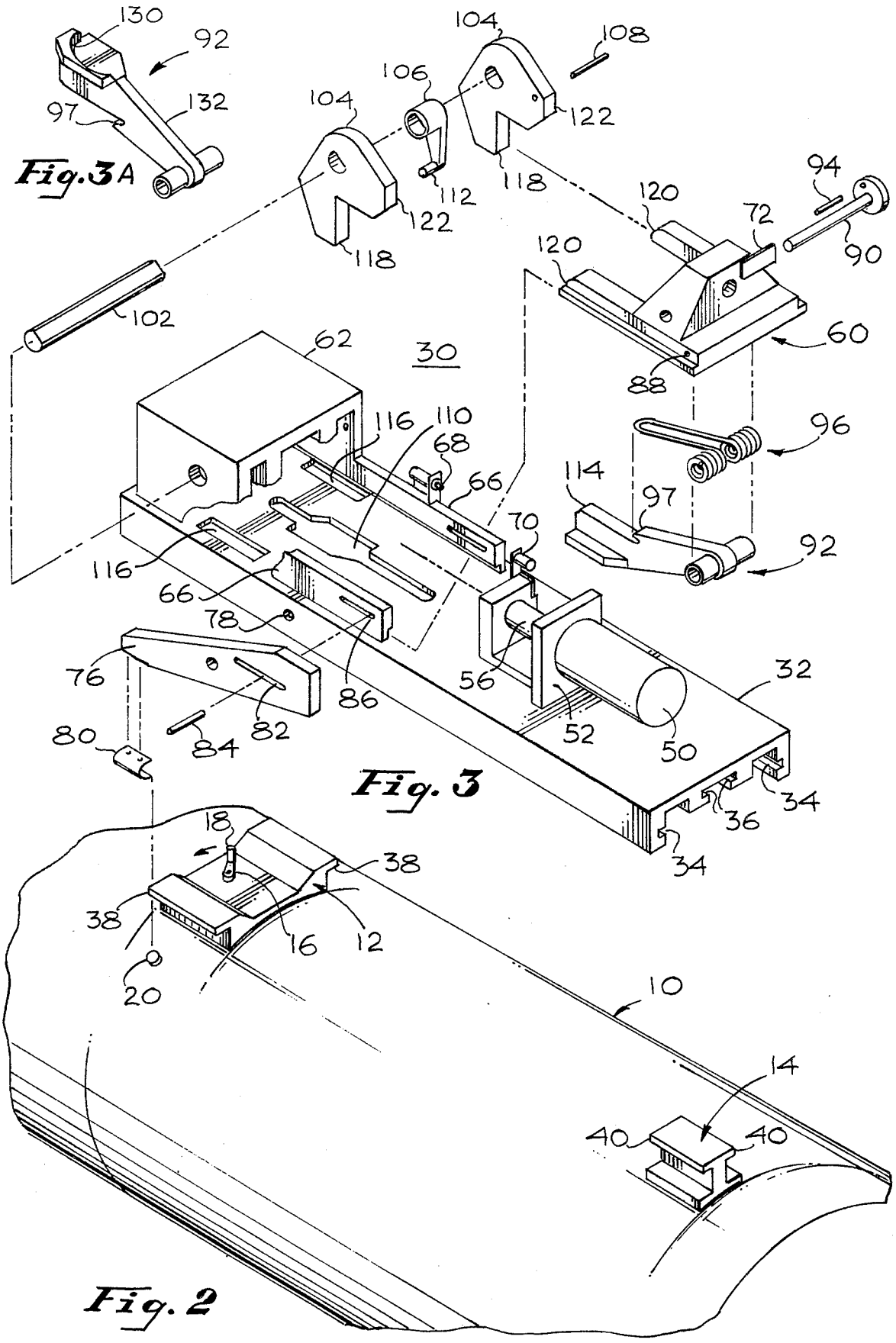
FIG. 2 is an enlarged view of a portion of the missile of FIG. 1, showing the details of the support brackets or shoes.
FIG. 3 is an exploded view of the mechanism of the present invention, arranged in operative spatial relationship to the missile portion depicted in FIG. 2.
FIG. 3A is an inverted view of an element shown in FIG. 3.

As shown in FIGS. 1 and 2, a rocket 10 of the type for which arming devices in accordance with the present invention are to be used, has a pair of support brackets or shoes 12 and 14 mounted thereon and arranged to support the rocket prior to and during launch by engaging the launch rail of the launching device. The forward shoe 12 has associated with it a pivotably mounted arming lever 16 coupled to an arming mechanism inside the rocket 10. The arming lever 16 includes an outwardly extending projection in the form of a pin 18 attached to its free end for engagement with an associated mechanism in the arming device of the launcher. Positioned on both sides of the forward shoe 12 are a pair of fire button contacts 20, one of which is shown in FIG. 2. The contacts 20 are connected to internal rocket ignition circuitry and, when contacted by the launcher arming device, couple the control circuit to fire the rocket motor. The arming lever 16, when rotated through approximately 80° counterclockwise, moves the internal arming mechanism from the "safe" position to the "armed" position.

The arming device 30 in accordance with the present invention is shown in the exploded view of FIG. 3 and in the other views of FIGS. 4–10 of the drawing. The arming device 30 is mounted on a launch rail of a missile launcher (not shown) which incorporates power and control circuitry for activating the arming device 30. Such circuitry has been omitted for the sake of simplicity. As indicated in FIGS. 2 and 3, the arming device 30 is in the relative juxtaposition in which the rocket 10 is mounted on the launch rail 32 in preparation for launch. The launch rail 32 is provided with separate sets of guide slots 34 and 36 for engaging respectively the raised lateral extensions 38 and 40 of the forward and aft shoes 12 and 14 of the rocket 10. It will be noted that the aft shoe 14 is narrower than the forward shoe 12 and its top surface is higher than that of the forward shoe. With the arming lever 16 being recessed somewhat relative to the outer surface of the forward shoe 12, it will be seen that there is clearnace for the arming lever 16 below the central portion of the launch rail 32 which defines the guide slot 36.

The arming device 30 comprises a gear motor 50 supported in a motor mount 52 affixed to the launch rail 32. Also supported in the motor mount 52 and extending longitudinally from the forward end thereof is a screw member 54 (see FIG. 6) which is coupled to be driven by the shaft of the gear motor 50 by means of a coupling member 56. A shuttle 60 is constrained by a forward housing 62, affixed to the launch rail 32, in a manner which permits bi-directional longitudinal movement of the shuttle 60 when driven by a ball bearing nut 64 (FIG. 6) affixed to the shuttle 60 and mounted on the ball screw member 54. The so-called "ball bearing screw" comprising the combination of screw member 54 and ball bearing nut 64 is a well-known device for converting rotary motion of a shaft such as the motor 50 into precisely controlled linear motion such as is employed in the present invention to activate the various mechanisms performing the functions described herein.

The housing 62 is provided with a pair of rearwardly extending legs 66 which serve, among other things, to restrain the shuttle 60 in position against the launch rail 32 for forward and aft traversal motion as described. A forward travel limit switch 68 is mounted on one of the legs 66. An aft travel limit switch 70 is mounted on the motor mount 52. These limit switches 68, 70 are connected in the control circuitry for the motor 50 and are alternately activated at the respective traversal limits of the shuttle 60 by means of a switch tripper bar 72 affixed to the shuttle 60 in a position to engage the switches 68, 70.

A pair of fire button arms 76, one of which is shown in FIG. 3, are pivotably mounted laterally outward of the launch rail 32 at pivot points 78. Each fire button arm 76 has affixed at its outer end a spring-type fire button contact 80 for making contact with the associated contact button 20 of the missile 10. An inclined slot 82 is cut in the arm 76 through which extends a cam pin 84 which also extends through a horizontal slot 86 in the housing leg 66 and is mounted on the shuttle 60 at the point 88. By means of the cam pin 84 and the slots 82, 86, the arm 76 is caused to rotate about the pivot point 78 as the shuttle 60 traverses back and forth, the fire button contact 80 moving into engagement with the corresponding button 20 of the missile 10 when the shuttle 60 moves to its aft position.

Mounted interiorly of the shuttle 60 on an arm shaft 90 is an arming member 92. The arm shaft 90 is held in position in the shuttle 60 by a roll pin 94. An arming member spring 96, mounted to engage a notch 97 of the arming member 92 and associated spring collars (not shown) positioned interiorly of the shuttle 60 on the shaft 90, serves to bias the arming member 92 for upwardly rotational movement about the shaft 90.

Mounted in the housing 92 is a laterally oriented restraint shaft 102 which has a flat side along the extent thereof. Affixed on the shaft 102 in mating recesses of the housing 62 are a pair of restraint levers 104 and an arming member latch 106. A shear pin 108 extends through a lever portion of the restraint lever 104 and associated portions of the housing 62.

The launch rail 32 is provided with an opening 110 through which the arming member 92 and lower extended portion of the arming member latch 106 extend. The lower portion of the latch member 106 is provided with a pin 112 for bearing against the upper flat surface 114 of the arming member 92. Openings 116 are also provided through which the lower ends 118 of the restraint levers 104 extend. In the "restrain" position, the ends 118 of the restraint levers 104 bear against the forward shoe 12 of the rocket 10 and prevent its release from the launcher. The shuttle 60 is provided with a pair of forwardly extending legs 120 which, when the shuttle 60 is in the forward position, bear against the underside of rearwardly extending portions 122 of the restraint levers 104, thus preventing the rotation of the restraint levers 104 and release of the rocket 10, even against full thrust in the event of an inadvertent firing. When the shuttle 60 is in the full aft position, the legs 120 disengage from the rearward portions 122 of the restraint levers 104 so that these levers can rotate to release the rocket. The shear pin 108 is designed to retain the restraint levers 104 in the "restrain" position until the rocket has built up a predetermined minimum thrust, at which point the shear pin 108 ruptures and the rocket is released.

Details of the underside of the arming member 92 are shown in FIG. 3A which depicts the member in an inverted position. As shown therein, the underside of the member 92 is provided with a curved cam surface 130 which is so shaped to engage the portion 18 of the arming lever 16 of the rocket 10 and rotate the lever 16 in the counterclockwise direction against clockwise spring bias as the member 92 is moved aft by the traversal of the shuttle 60 in the aft direction as driven by the motor 50. Movement of the member 92 in the forward direction disengages the camming surface 130 from the portion 18 of the arming lever 16, permitting the latter to return to the "safe" condition. The member 92 is provided with a ramp surface 132 along a rearward portion thereof so that, in the event of failure of the biasing spring 96, the forward motion of the aft shoe 14 as the rocket 10 is launched, causes retraction of the member 92 through the opening 110 of the launch rail 32.

Figure 5:
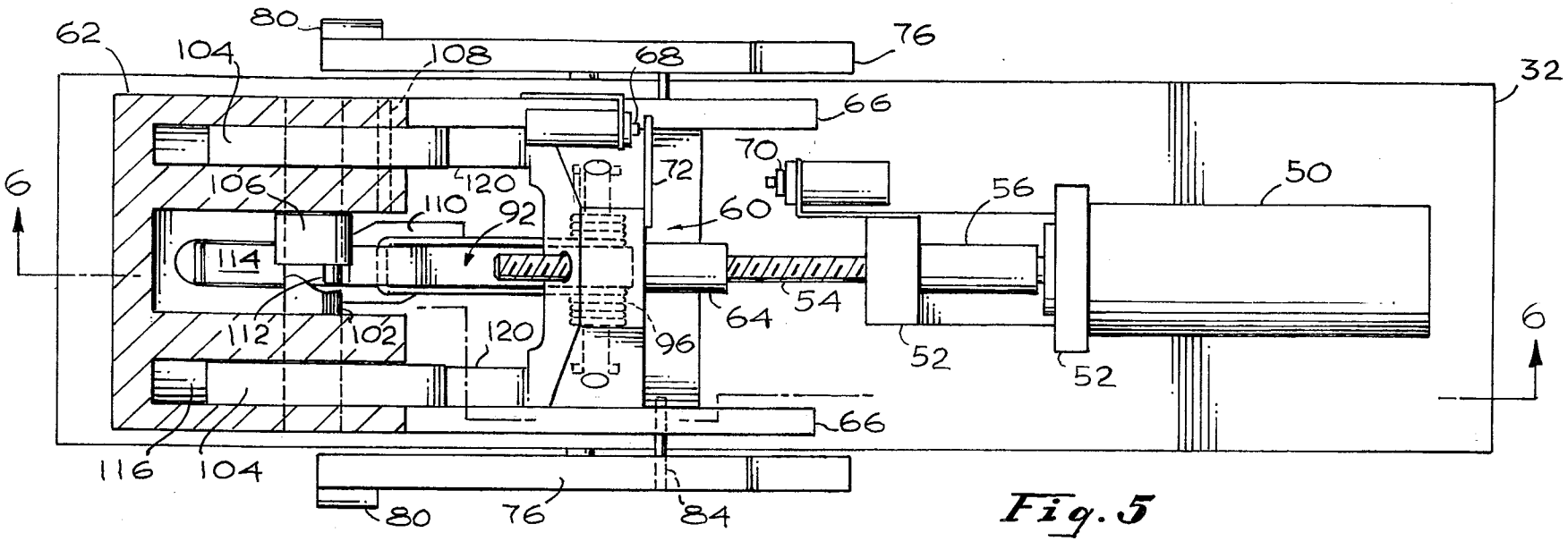
FIG. 5 is a plan sectional view of the arrangement in accordance with the present invention, taken along the line 5—5 of FIG. 4 and looking in the direction of the arrows.
Figure 6:
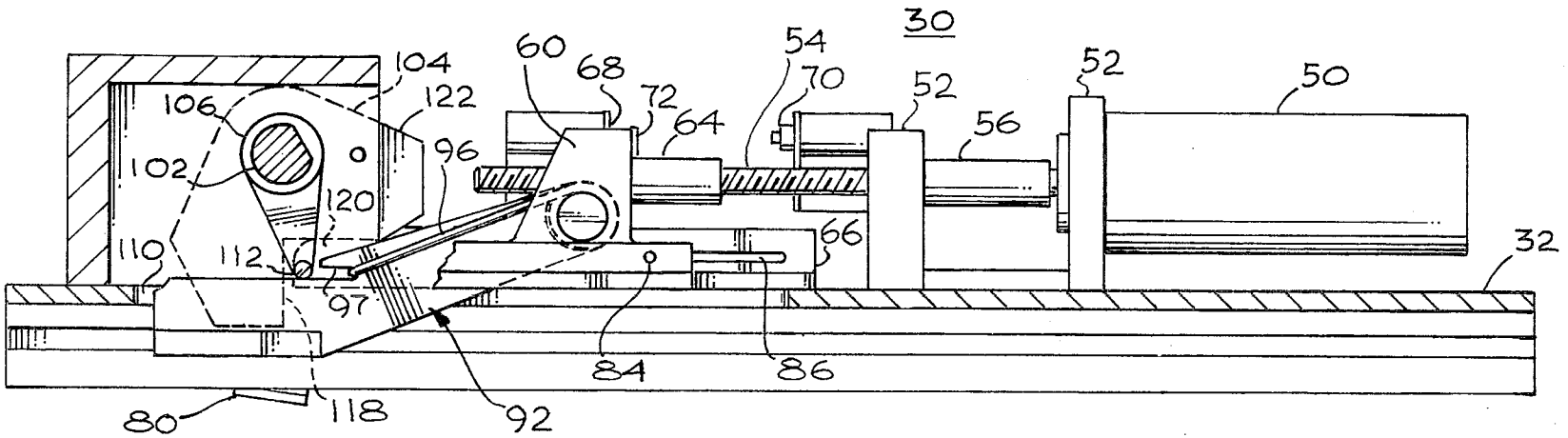
FIG. 6 is a side sectional view of the arrangement in accordance with the invention, taken along the line 6—6 of FIG. 5 and looking in the direction of the arrows.

Operation of the device will be described by reference to FIGS. 4–10. In particular, FIGS. 5 and 6 show the shuttle 60 with associated components in the forward position, corresponding to storage of the rocket 10 on the launcher 32 in readiness for arming and firing. In this position, the forward legs 120 of the shuttle 60 are positioned under the rearward portions 122 of the restraint levers 104, the lower portions 118 of which engage the portions 38 of the forward rocket shoe 12 so that, even if the rocket were inadvertently fired and developing full thrust, it could not be released from the launch rail 32.

Figure 7:
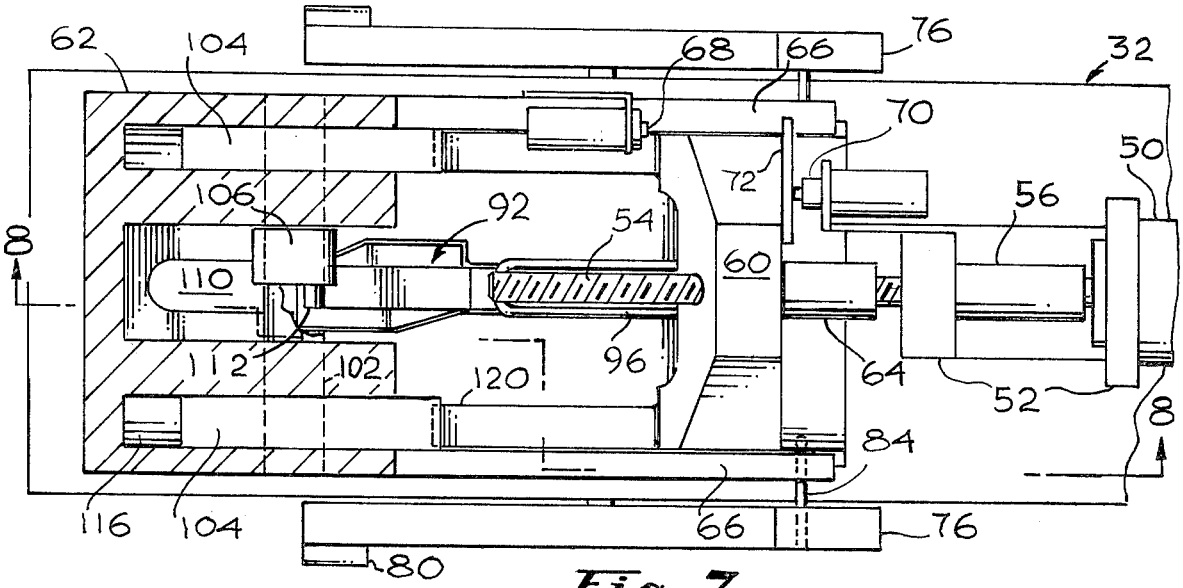
FIG. 7 is a combination plan and sectional view corresponding to FIG. 5, showing the mechanism in its relative position following a sequence of movements to arm the associated missile.
Figure 8:
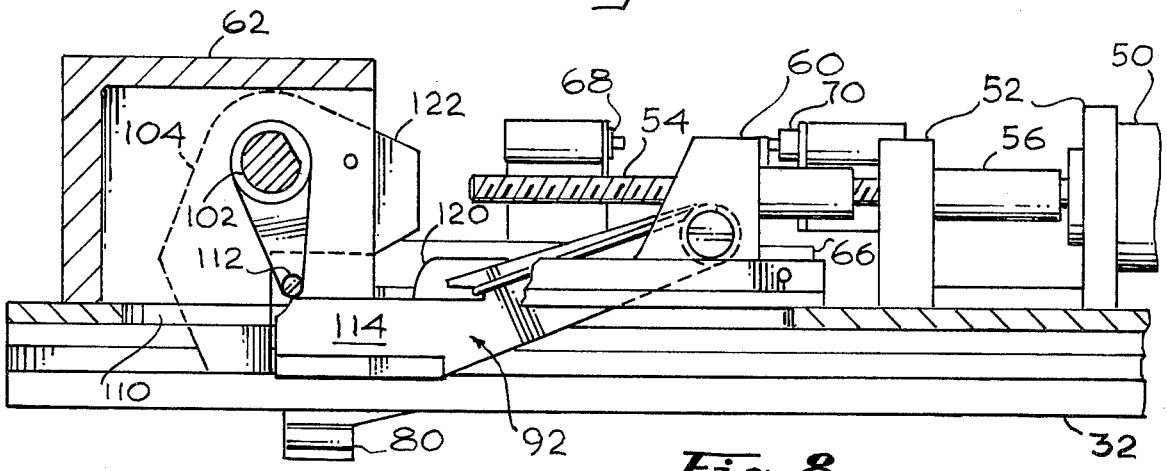
FIG. 8 is a side sectional view taken along the line 8—8 of FIG. 7, also showing the mechanism following the arming sequence.

FIGS. 7 and 8 illustrate the shuttle 60 and associated components in the aft position in which the missile is armed and in readiness for launch. The arming sequence representing the transition between the positions of FIGS. 5, 6 and FIGS. 7, 8 is set forth in the following paragraph.

The gear motor 50 through the coupling 56 rotates the ball bearing screw member 54 to retract (move aft) the shuttle 60. In moving aft, the shuttle 60 moves the arming member 92 aft across the rocket motor arming lever 16. The configuration of the cam surface 130 on the underside of the arming member 92 engages the protruding portion 18 of the rocket motor arming lever 16 and, as the arming member 92 moves aft across the lever 16, it rotates the arming lever 16 to the "armed" position. The same aft movement of the shuttle 60 rotates the fire button arms 76 so that the contacts 80 thereon move down against the rocket motor fire button contacts. This rotation of the arms 76 is a result of the cam pin 84 acting against the inclined cam slots 82 in the fire button arms 76. Also as the shuttle 60 moves aft, the forward legs of the shuttle 60 move out from under the rearward portions 122 of the two restraint levers 104. The levers 104 are then free to rotate in the clockwise direction after sufficient rocket motor thrust has developed to shear the pin 108. The proper aft position of the shuttle 60 is sensed by the activation of the aft limit switch 70.

If desired, the rocket motor may be returned to the "safe" condition by simply activating the gear motor 50 to run in the opposite direction so as to drive the shuttle 60 to its forward limit, thus retracting the rocket motor fire button arms 76 and moving the arming member 92 forward, thus safing the rocket motor arming mechanism. When the shuttle 60 is in the forward position, as sensed by the forward limit switch 68, the restraint levers 104 are prevented from rotating by engagement with the forward legs 120 of the shuttle 60.

Figure 9:
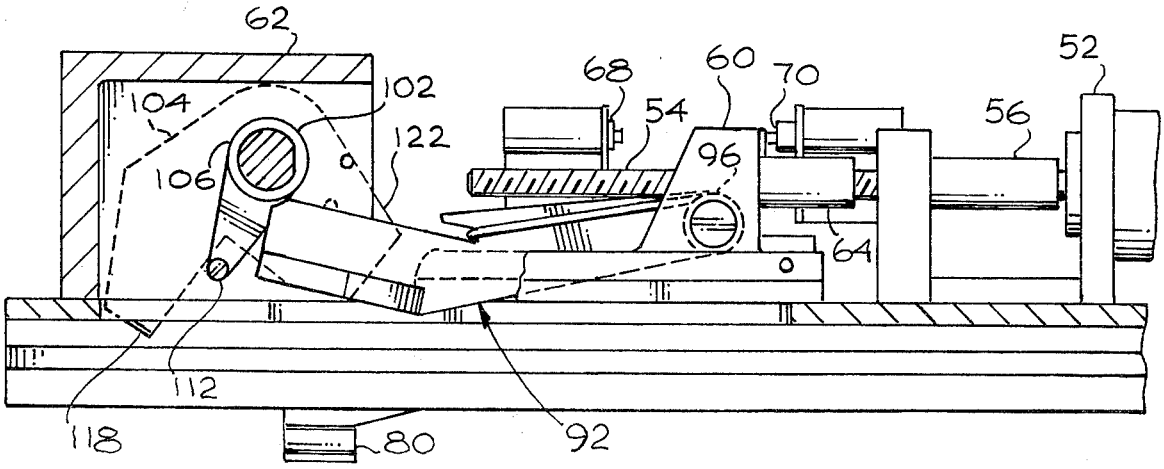
FIG. 9 is a side sectional view, also taken along the line 8—8 of FIG. 7 but showing the position of the mechanism following completion of the launch sequence.

FIG. 9 represents the various components comprising the arming device in accordance with the present invention in the launch position with the rocket having been released. The sequence of transition from the armed position of FIGS. 7 and 8 to the position of FIG. 9 is described in the following paragraph.

In the armed position, the missile is free to fly forward upon ignition by the associated control circuitry of the launcher (not shown). As the missile moves forward, after sufficient thrust is developed to shear the "Fly-Thru" pin 108, the missile forward shoe 12 pushes against the lower portions 118 of the restraint levers 104 and thus rotates them up out of the way. Rotation of the restraint levers 104 in the clockwise direction causes the arming member latch 106 to also rotate, since the restraint levers 104 and the arming member latch 106 are keyed together through the restraint shaft 102. The arming member 92 is held down in place by the arming member latch 106 until the latter rotates forward so that the lower portion thereof 112 clears the arming member 92. At that point, the arming member 92 is caused to rotate up through the slot 110 in the launch rail 32 by arming member spring 96. When the arming member 92 is rotated upward, the aft missile shoe 14 can travel down the slots 36 of the guide rail 32 without interference. In the event of failure of the spring 96, the arming member 92 is retracted anyway by the aft shoe 14 bearing against the ramp surface 132.

By virtue of the simple but effective construction and cooperation of the components of the mechanism described hereinabove, an arming device achieving extreme simplicity and reliability is provided for performing the functions desired in a vertical launcher of rocket missiles of the type decribed herein. The device has the capability of restraining a rocket against full thrust in the event of inadvertent firing. It effectively arms the missile with the capability of returning the missile from the armed to the safe condition; and it restrains the missile upon firing until a predetermined minimum thrust is developed which will assure an effective launch.

Although there has been described above a particular arrangement of a missile launcher arming device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A bi-directional linear actuator arming device for use with a rocket missile launcher having a guide rail for engaging support members on the missile comprising:

a housing mounted on the guide rail and supporting rotatable restraining means extending through openings in the guide rail to engage portions of the missile;

a selectively reversible motor having a shaft rotatable in either direction;

a linear traversal shuttle member movable along the guide rail between an extended position of engagement with the restraining means and a retracted position out of engagement with the restraining means;

means coupled between the motor shaft and the shuttle member for converting rotational movement of the motor shaft to linear traversal movement of the shuttle member between the extended and retracted positions; and means coupled to the shuttle member and movable therewith for changing the condition of the missile between safe and armed conditions when the shuttle member moves between the extended and retracted positions.

2. Apparatus in accordance with claim 1 wherein the shuttle member includes interfering means for blocking the release of the restraining means when the shuttle member is in the extended position, the interfering means being attached to the shuttle member for movement out of the way of the restraining means when the shuttle member is in the retracted position.

3. Apparatus in accordance with claim 1 further including releasable interference means for releasing the restraining means only upon the application of a predetermined minimum force against the restraining means.

4. Apparatus in accordance with claim 3 wherein the releasable interference means comprises a shear pin extending between the restraining means and the housing.

5. Apparatus in accordance with claim 1 wherein the means for convertng rotational shaft motion to linear traversal motion of the shuttle member comprises a ball bearing screw member coupled to rotate with the motor shaft and a ball bearing nut coupled thereto and affixed to the shuttle member.

6. Apparatus in accordance with claim 5 further including first and second limit switches for sensing the presence of the shuttle member at the respective limits of its linear traversal movement.

7. Apparatus in accordance with claim 1 further including an arming member pivotably mounted to the shuttle member for extending through an opening in the launcher guide rail to engage an arming lever of the associated missile.

8. Apparatus in accordance with claim 7 wherein said arming member includes a curved camming surface operative to engage the missile arming lever to move said lever to the armed position as the shuttle member is driven to the retracted position.

9. Apparatus in accordance with claim 8 wherein said curved camming surface is operative to restore the missile arming lever to the safe position as the arming member is moved with the shuttle member to the extended position after having armed the missile.

10. Apparatus in accordance with claim 8 further including a spring engaging the arming member and biasing said arming member toward a retracted position out of engagement with the missile arming lever.

11. Apparatus in accordance with claim 10 further including a latch member supported by said housing and rotatable with said restraining means for maintaining the arming member in a position of engagement with the missile arming lever until rotation of the restraining means by forward motion of the missile upon firing.

12. Apparatus in accordance with claim 10 wherein the arming member includes a ramp surface for engaging a portion of the missile and retracting said arming member in response to forward motion of the missile upon firing thereof in the event of failure of the biasing spring.

13. Apparatus in accordance with claim 1 further including contact means pivotably mounted to the guide rail and means coupled between the contact means and the shuttle member for extending the contact means to engage contact elements on the associated missile and retracting the contact means from such engagement in response to respective movements of the shuttle member to and from its retracted position.

14. Apparatus in accordance with claim 13 wherein the contact means comprises a pair of fire button arms mounted on opposite sides of the guide rail, each having a spring contact element at one end thereof and an inclined cam slot, and wherein the coupled means comprises a pair of cam pins mounted on the shuttle member and extending to engage respective ones of said cam slots.

* * * * *